US008294053B2

(12) United States Patent
Shimura et al.

(10) Patent No.: US 8,294,053 B2
(45) Date of Patent: Oct. 23, 2012

(54) ELECTRONIC KEY

(75) Inventors: Tokio Shimura, Anjo (JP); Mitsuru Nakagawa, Chiryu (JP)

(73) Assignee: Denso Corporation, Kariya (JP)

( * ) Notice: Subject to any disclaimer, the term of this patent is extended or adjusted under 35 U.S.C. 154(b) by 275 days.

(21) Appl. No.: 12/658,968

(22) Filed: Feb. 18, 2010

(65) Prior Publication Data

US 2010/0206704 A1 Aug. 19, 2010

(30) Foreign Application Priority Data

Feb. 19, 2009 (JP) ..... 2009-037087

(51) Int. Cl.
*H01H 13/06* (2006.01)

(52) U.S. Cl. ..... 200/302.2; 200/514

(58) Field of Classification Search ..... 200/302.2, 200/302.1, 512, 513, 516, 517
See application file for complete search history.

(56) References Cited

U.S. PATENT DOCUMENTS

| | | | | |
|---|---|---|---|---|
| 5,193,669 | A * | 3/1993 | Demeo et al. | 200/302.2 |
| 2004/0085251 | A1 | 5/2004 | Shimura | |
| 2004/0090737 | A1 * | 5/2004 | Shimura et al. | 361/680 |
| 2004/0200709 | A1 | 10/2004 | Sugimoto et al. | |

FOREIGN PATENT DOCUMENTS

| | | |
|---|---|---|
| JP | 11-280313 | 10/1999 |
| JP | 2004-150184 | 5/2004 |
| JP | 2004-312621 | 11/2004 |

* cited by examiner

*Primary Examiner* — Felix O Figueroa
(74) *Attorney, Agent, or Firm* — Harness, Dickey & Pierce, PLC

(57) ABSTRACT

An electronic key includes a case having therein an internal space; a circuit board including a transmit portion for transmitting a radio wave, a control portion for outputting a control signal for instructing the transmit portion to send the radio wave and an internal switch for instructing the control portion to output the control signal; a waterproof cover for protecting the circuit board; an external switch configured to be bent when being pressed by a user; and a flexible sheet arranged between the waterproof cover and a surface of the circuit board on which the internal switch is arranged. The circuit board, the flexible sheet, the waterproof cover and the external switch are arranged in series in the internal space. The internal switch receives a press-force by the user from the external switch via the waterproof cover and the flexible sheet.

1 Claim, 1 Drawing Sheet

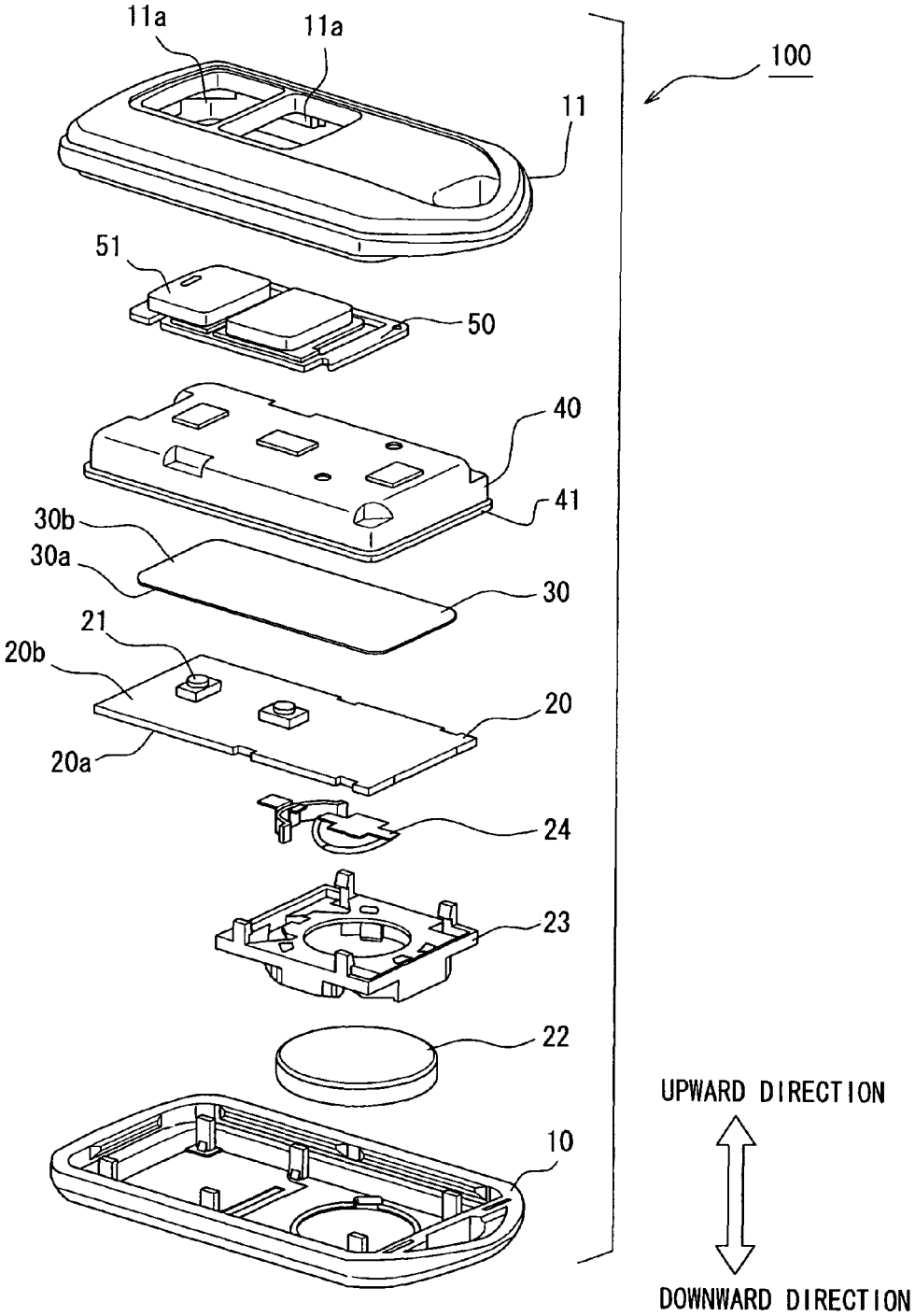
11a
11a
100
11
51
50
40
41
30b
30a
30
21
20b
20
20a
24
23
22
10
UPWARD DIRECTION
DOWNWARD DIRECTION

ELECTRONIC KEY

CROSS REFERENCE TO RELATED APPLICATION

The present application is based on Japanese Patent Application No. 2009-37087 filed on Feb. 19, 2009, the disclosure of which is incorporated herein by reference.

FIELD OF THE INVENTION

The present invention relates to an electronic key applied to a keyless entry system for a vehicle, for example.

BACKGROUND OF THE INVENTION

JP-A-2004-150184 corresponding to US 2004/0085251 describes a conventional portable unit, for example. The portable unit has an internal space constructed of an upper cover and a lower cover. In the internal space, a knob member, a waterproof cover, a substrate having a switch on an upper surface thereof and an antenna element on a lower surface thereof are disposed in series from above. The portable unit is configured such that, when a user presses the knob member and the knob member and the waterproof cover are bent, a press-force is applied to the switch on the substrate.

In the portable unit described in JP-A-2004-150184, the waterproof cover is in directly contact with the switch. Thus, the user presses the knob member so that the waterproof cover is in line-contact with or in point-contact with the switch and localized stress is applied to the waterproof cover from the switch, thereby, the waterproof cover may be damaged. In particular, in the case where the switch is long-pushed to lift a window, for example, the waterproof cover may be in line-contact with or in point-contact with the switch for a long time. Therefore, the localized stress is applied to the waterproof cover from the switch and the waterproof cover may be damaged.

SUMMARY OF THE INVENTION

In view of the above points, it is an object of the present invention to provide an electronic key in which a waterproof cover can be restricted from being damaged.

According to one aspect of the present invention, an electronic key includes a case having therein an internal space; a circuit board including a transmit portion configured to transmit a radio wave, a control portion configured to output a control signal for instructing the transmit portion to send the radio wave and an internal switch configured to instruct the control portion to output the control signal; a waterproof cover for restricting the circuit board from being exposed to water; an external switch configured to be bent when being pressed by a user; and a flexible sheet arranged between the waterproof cover and a surface of the circuit board on which the internal switch is arranged. A part of the external switch is exposed from an opening of the case. The circuit board, the flexible sheet, the waterproof cover and the external switch are arranged in series in the internal space. The internal switch receives a press-force by the user from the external switch via the waterproof cover and the flexible sheet.

According to the configuration, the flexible sheet is disposed between the waterproof cover and the internal switch. Thus, the flexible sheet can restrict the waterproof cover from being in directly contact with the internal switch. The flexible sheet is bent in response to the press-force transmitted via the external switch and the waterproof cover, thereby the flexible sheet is in plane-contact with the waterproof cover. Because uniform stress is applied to the waterproof cover from the flexible sheet, localized stress can be restricted from being applied to the waterproof cover from the internal switch. Therefore, the waterproof cover can be restricted from being damaged.

BRIEF DESCRIPTION OF THE DRAWING

The above and other objects, features and advantages of the present invention will become more apparent from the following detailed description made with reference to the accompanying drawing. In the drawing:

FIGURE is an exploded perspective view showing an electronic key according to an embodiment.

DETAILED DESCRIPTION OF THE PREFERRED EMBODIMENTS

Hereinafter, an embodiment in which an electronic key according to the present invention is applied to a keyless entry system for a vehicle will be described with reference to FIGURE.

(Embodiment)

As shown in FIGURE, in the present embodiment, a direction toward an upper case 11 from a lower case 10 is referred to as an upward direction, and a direction toward the lower case 10 from the upper case 11 is referred to as a downward direction.

An electronic key 100 includes the lower case 10, the upper case 11, a circuit board 20, a flexible sheet 30, a waterproof cover 40 and an external switch 50. The lower case 10 is engaged with the upper case 11 to define an internal space. In the internal space, the circuit board 20, the flexible sheet 30, the waterproof cover 40 and the external switch 50 are disposed in series upwardly from a side of the lower case 10. The circuit board 20, the flexible sheet 30, the waterproof cover 40 and the external switch 50 are fixed in the internal space with sandwiched between the lower case 10 and the upper case 11.

The circuit board 20 includes a transmit portion (not shown in the drawing) configured to transmit a radio wave, a control portion (not shown in the drawing) configured to output a control signal for instructing the transmit portion to send the radio wave, and plural internal switches 21 configured to instruct the control portion to output the control signal. Electric power for driving the control portion is supplied from a battery cell 22 connected to a lower surface 20*a* of the circuit board 20, which faces in the downward direction. The battery cell 22 is mechanically connected to the circuit board 20 by a holder 23, and is electrically connected to the circuit board 20 by a terminal 24. The internal switch 21 is mounted on an upper surface 20*b* of the circuit board 20, which faces in the upward direction, so as to be opposed to a press portion 51 of the external switch 50 with the flexible sheet 30 and the waterproof cover 40 interposed therebetween.

The flexible sheet 30 is disposed between the circuit board 20 and the waterproof cover 40. The flexible sheet 30 restricts the waterproof cover 40 from being in directly contact with the internal switch 21 and from being in line-contact with or in point-contact with the internal switch 21. A part of a lower surface 30*a* of the flexible sheet 30, which faces in the downward direction, is in contact with the internal switch 21, and a whole surface of an upper surface 30*b* of the flexible sheet 30, which faces in the upward direction, is in contact with the waterproof cover 40. The flexible sheet 30 according to the present embodiment has a rectangular-planar shape and is made from polyethylene terephthalate (PET). A thickness of the flexible sheet 30 is approximately 0.1 mm.

The waterproof cover 40 is disposed between the flexible sheet 30 and the external switch 50, and restricts the circuit board 20 from being exposed to water. The waterproof cover 40 has a box-like shape having an opening and houses therein the circuit board 20 and the flexible sheet 30. Thus, the waterproof cover 40 restricts the circuit board 20 from being exposed to water, and restricts the circuit board 20 and the flexible sheet 30 from moving in a direction perpendicular to the upward direction and the downward direction. A ring-shaped sealing portion 41 is disposed on an edge portion defining the opening of the waterproof cover 40, and the sealing portion 41 is along the edge portion. The sealing portion 41 is sandwiched between an inner surface of the lower case 10 and an inner surface of the upper case 11 and is elastically-deformed when attaching the lower case 10 to the upper case 11 so that sealing performance at a contact portion between the lower case 10 and the upper case 11 can be ensured. The waterproof cover 40 according to the present embodiment is made from silicone rubber.

When a user presses the external switch 50, the external switch 50 is bent and transmits press-force to the internal switch 21. The external switch 50 includes plural press portions 51 exposed to the outside from opening portions 11*a* provided in the upper case 11. By pressing the exposed press portion 51 downwardly, the press-force by the user is applied to the internal switch 21 via the external switch 50, the waterproof cover 40 and the flexible sheet 30.

When the internal switch 21 is turned on by the press-force by the user, a control signal for instructing to send a radio wave is input into the transmit portion from the control portion, and the transmit portion transmits a radio wave including the control signal. When a vehicle receives the radio wave including the control signal, the vehicle performs the instruction included in the control signal. An example of the control signal includes an unlock control signal for instructing to unlock a door of the vehicle, a lock control signal for instructing to lock the door of the vehicle, and a lift control signal for instructing to lift a window of the vehicle. When the internal switch 21 is long-pushed, the lift control signal is input into the transmit portion from the control signal.

Next, the feature of the present embodiment and the effect thereof will be described. As described above, in the electronic key 100 according to the present embodiment, the flexible sheet 30 is disposed between the circuit board 20 and the waterproof cover 40. Thus, when the user presses the press portion 51 downwardly, the press-force is transmitted to the internal switch 21 via the press portion 51, the waterproof cover 40 and the flexible sheet 30. The flexible sheet 30 is bent in response to the press-force transmitted via the press portion 51 and the waterproof cover 40, thereby the flexible sheet 30 is in plane-contact with the waterproof cover 40 and is in line-contact with or in point-contact with the internal switch 21. Because the flexible sheet 30 is in line-contact with or in point-contact with the internal switch 21, localized stress is applied to the flexible sheet 30 from the internal switch 21. On the other hand, because the flexible sheet 30 is in plane-contact with the waterproof cover 40, uniform stress is applied to the waterproof cover 40 from the flexible sheet 30. In this manner, the electronic key 100 according to the present embodiment is configured such that the waterproof cover 40 is not in directly contact with the internal switch 21 and the uniform stress is applied to the waterproof cover 40 from the flexible sheet 30 unlike a conventional electronic key without a flexible sheet. Thus, the waterproof cover 40 can be restricted from being damaged.

(Other Embodiments)

The present invention is not limited to the above embodiment, and can be modified in various ways without departing from the scope of the invention.

According to the present embodiment, the electronic key 100 is applied to a keyless entry system. However, in the case where the electronic key 100 has a receive portion configured to receive a radio wave, the electronic key 100 can be applied to a smart entry system. In the smart entry system, the electronic key 100 sends an answer signal with respect to a response signal, which is sent to the electronic key 100 from the vehicle, to the vehicle, and the vehicle checks an ID of the electronic key 100 included in the response signal against an ID included in the vehicle so that the vehicle and the electronic key 100 are authenticated. When the ID of the electronic key 100 corresponds to the ID of the vehicle, the vehicle is changed to be in a preparatory state for accepting the control signal. In the preparatory state, if the radio wave including the control signal is sent to the vehicle from the electronic key 100, the vehicle performs the instruction included in the control signal. In particular, unlocking-locking the door of the vehicle, lifting the window of the vehicle or the like is performed.

According to the present embodiment, the flexible sheet 30 is made from PET. However, a material for the flexible sheet 30 is not limited thereto. For example, the flexible sheet 30 may be made from polycarbonate (PC).

According to the present embodiment, the thickness of the flexible sheet 30 is approximately 0.1 mm. However, the thickness of the flexible sheet, 30 is not limited thereto as long as the internal switch 21 that is opposed to one press portion 51 via the waterproof cover 40 and the flexible sheet 30 is not turned on even when the flexible sheet 30 is bent by the press-force applied to another press portion 51.

According to the present embodiment, when the internal switch 21 is long-pushed, the lift control, signal for instructing to lift the window of the vehicle is input into the transmit portion from the control signal. However, when the internal switch 21 is long-pushed, a storage-deployment control signal for instructing, to store and deploy a seat of the vehicle may be input into the transmit portion from the control signal.

While the invention has been described with reference to preferred embodiments thereof, it is to be understood that the invention is not limited to the preferred embodiments and constructions. The invention is intended to cover various modification and equivalent arrangements. In addition, while the various combinations and configurations, which are preferred, other combinations and configurations, including more, less or only a single element, are also within the spirit and scope of the invention.

What is claimed is:

1. An electronic key comprising:

a case having therein an internal space;

a circuit board including a transmit portion configured to transmit a radio wave, a control portion configured to output a control signal for instructing the transmit portion to send the radio wave and an internal switch configured to instruct the control portion to output the control signal;

a waterproof cover for restricting the circuit board from being exposed to water;

an external switch configured to be bent when being pressed by a user, a part of the external switch being exposed from an opening of the case; and a monolithical flexible sheet arranged between the waterproof cover and a surface of the circuit board on which the internal switch is arranged, wherein the circuit board, the flexible sheet, the waterproof cover and the external switch are arranged in series in the internal space, the internal switch receives a press-force by the user from the external switch via the waterproof cover and the flexible sheet; and the press-force by the user causes direct contact between the external switch and the waterproof cover, direct contact between the waterproof cover and the flexible sheet and direct contact between the flexible sheet and the internal switch to enable the internal switch to receive the press-force.

* * * * *